US010711583B2

(12) United States Patent
Parrella

(10) Patent No.: US 10,711,583 B2
(45) Date of Patent: Jul. 14, 2020

(54) GREEN BOILER—CLOSED LOOP ENERGY AND POWER SYSTEM TO SUPPORT ENHANCED OIL RECOVERY THAT IS ENVIRONMENTALLY FRIENDLY

(71) Applicant: GTHERM ENERGY, INC., Westport, CT (US)

(72) Inventor: Michael J. Parrella, Weston, CT (US)

(73) Assignee: GTHERM ENERGY, INC., Houston, TX (US)

( * ) Notice: Subject to any disclaimer, the term of this patent is extended or adjusted under 35 U.S.C. 154(b) by 219 days.

(21) Appl. No.: 15/517,616

(22) PCT Filed: May 19, 2015

(86) PCT No.: PCT/US2015/031486
§ 371 (c)(1),
(2) Date: Apr. 7, 2017

(87) PCT Pub. No.: WO2016/057085
PCT Pub. Date: Apr. 14, 2016

(65) Prior Publication Data

US 2017/0247993 A1 Aug. 31, 2017

Related U.S. Application Data

(60) Provisional application No. 62/061,462, filed on Oct. 8, 2014.

(51) Int. Cl.
*E21B 43/24* (2006.01)
*E21B 43/40* (2006.01)
(Continued)

(52) U.S. Cl.
CPC ..... *E21B 43/24* (2013.01); *E21B 36/006* (2013.01); *E21B 43/2406* (2013.01);
(Continued)

(58) Field of Classification Search
CPC .... E21B 43/24; E21B 36/006; E21B 43/2406; E21B 43/40
See application file for complete search history.

(56) References Cited

U.S. PATENT DOCUMENTS 3,066,733 A 12/1962 Brandon
3,125,072 A 3/1964 Brandt et al.
(Continued)

FOREIGN PATENT DOCUMENTS

WO 2013090901 6/2013

OTHER PUBLICATIONS

E.R. Rangel-German, et al., Abstract of "Electrical-heating-assisted recovery for heavy oil." Journal of Petroleum Science and Engineering, vol. 45, Issues 3-4, Dec. 15, 2004, pp. 213-231, available at www.sciencedirect.com/article/pii/S0920410504000993 (2 pages).
(Continued)

*Primary Examiner* — Caroline N Butcher
(74) *Attorney, Agent, or Firm* — Ware, Fressola, Maguire & Barber LLP

(57) ABSTRACT

A method and apparatus are shown for burning crude oil or natural gas extracted from an underground reservoir, or for burning both crude oil and natural gas extracted from an underground reservoir, for providing thermal energy. The method and apparatus are also shown transferring the thermal energy to brine separated from the extracted oil, gas or both, for providing heated brine, or for converting the thermal energy to mechanical work, or for both transferring the thermal energy to the separated brine and converting the thermal energy to mechanical work. The method and apparatus are also shown heating the underground reservoir with the heated brine injected into the underground reservoir, or heating the underground reservoir with a resistive cable energized by electricity generated by converting the
(Continued)

mechanical work to electric energy, or heating the underground reservoir with both the heated brine and the energized resistive cable.

17 Claims, 7 Drawing Sheets

(51) Int. Cl.
*E21B 36/00* (2006.01)
*F01K 7/16* (2006.01)
*F02B 65/00* (2006.01)

(52) U.S. Cl.
CPC ..... *E21B 43/40* (2013.01); *F01K 7/16* (2013.01); *F02B 65/00* (2013.01)

(56) References Cited

U.S. PATENT DOCUMENTS

| | | | | |
|---|---|---|---|---|
| 3,132,692 | A | 5/1964 | Marx et al. | |
| 3,520,362 | A | 7/1970 | Galle | |
| 4,077,220 | A | 3/1978 | Matthews | |
| 4,078,608 | A | 3/1978 | Allen et al. | |
| 4,319,632 | A | 3/1982 | Marr, Jr. | |
| 4,319,635 | A * | 3/1982 | Jones | E21B 43/16 166/127 |
| 4,325,432 | A | 4/1982 | Henry | |
| 4,418,752 | A | 12/1983 | Boyer et al. | |
| 4,465,136 | A | 8/1984 | Troutman | |
| 4,824,447 | A | 4/1989 | Goldsberry | |
| 5,695,643 | A * | 12/1997 | Brandt | C02F 1/441 166/267 |
| 6,012,521 | A | 1/2000 | Zunkel et al. | |
| 6,467,542 | B1 | 10/2002 | Kostrov et al. | |
| 6,536,523 | B1 | 3/2003 | Kresnyak et al. | |
| 6,585,046 | B2 | 7/2003 | Neuroth et al. | |
| 6,788,619 | B2 | 9/2004 | Calvert | |
| 6,988,549 | B1 | 1/2006 | Babcock | |
| 7,743,826 | B2 | 6/2010 | Harris et al. | |
| 7,814,975 | B2 | 10/2010 | Hagen et al. | |
| 8,851,169 | B2 | 10/2014 | Nikipelo | |
| 2003/0047309 | A1 | 3/2003 | Thomas et al. | |
| 2009/0008088 | A1 * | 1/2009 | Schultz | E21B 36/02 166/249 |
| 2009/0056944 | A1 | 3/2009 | Nitschke | |
| 2009/0065197 | A1 | 3/2009 | Eslinger | |
| 2009/0090503 | A1 | 4/2009 | Groves | |
| 2009/0120633 | A1 | 5/2009 | Webb et al. | |
| 2010/0126395 | A1 | 5/2010 | Gauthier | |
| 2010/0170453 | A1 | 7/2010 | Betzer-Zilevitch | |
| 2014/0083693 | A1 | 3/2014 | Frank | |
| 2014/0352947 | A1 | 12/2014 | Hallundbaek | |
| 2015/0138924 | A1 | 5/2015 | Schaefers et al. | |

OTHER PUBLICATIONS

Ahmad H. Haidari, et al., "Electrical Heating Methods for Oil Reservoir Stimulation", Mar. 11, 2013 (4 pages).
"Well Placement", www.niobraranews.net/well-placement, Jul. 2013 (8 pages).
Prats, Michael, Abstract for "Thermal Recovery", www.store.spe.org/Thermal-Recovery-P78.aspx, 1982 (2 pages).
"Porosity and Permeability", www.geomore.com/porosity-and-permeability-2, Feb. 2015 (3 pages).
Zusman, Neil, "Fracking: Gas Drilling and the Marcellus Shale", www.frack.mixplex.com/fracking, Aug. 24, 2010 (5 pages).
Gabe Bass, "Oil and Gas Basics: Drilling and Spacing Units." Bass Law, Jun. 4, 2012, 2 pages.
Albina Mukhametshina, et al., "Electromagnetic Heating of Heavy Oil and Bitumen: A Review of Experimental Studies and Field Applications." Journal of Petroleum Engineering, vol. 2013, Mar. 11, 2013, 7 pages.
"Thermal Recovery Methods for Heavy Oil Fields", www.mobilityoilandgas.com/thermal-recovery-methods-for-heavy-oil-fields, Apr. 2015 (5 pages).
Khalid Rashid Alnoaimi, "Heavy Oil Recovery: Definitions and Means", www.large.stanford.edu/courses/2010/ph240.alnoaimi1, Stanford University, Oct. 23, 2010, 5 pages.
Roger M. Butler, "Thermal Recovery of Oil and Bitumen", Department of Chemical and Petroleum Engineering, University of Calgary, 1991, pp. i-xi, 30-47 and 72-85.
"Steam-assisted gravity drainage", www.wikipedia.org/wiki/Steam-assisted_gravity_drainage, Nov. 2014 (8 pages).
"Pressure gradient", www.wikipedia.org/wiki/Pressure-gradient, Nov. 2014 (2 pages).
"Gradient", www.wikipedia.org/Gradient, Nov. 2014 (8 pages).
"Pressure-gradient force", www.wikipedia.org/Pressure-gradient-force, Nov. 2014 (2 pages).
"Oversight Hearing on Spinning Straw Into Black Gold: Enhanced Oil Recovery Using Carbon Dioxide", U.S. House of Representatives Subcommittee on Energy and Mineral Resources Committee on Natural Resources, Jun. 12, 2008 (41 pages).
Laura Romero-Zeron, "Advances in Enhanced Oil Recovery Processes", www.intechopen.com, May 2012 (43 pages).
"The Global Taxonomy Initiative—The Response to a Problem", Secretariat of the Convention on Biological Diversity, Mar. 2015 (2 pages).
"Turbine", www.wikipedia.org/wiki/Turbine, Mar. 2015 (9 pages).
Per Johansson, et al., "Heavy Crude Oil as a Fuel for the SGT-500 Gas Turbine", VIII Forum Turbomaquinas Petrobras, Aug. 2011 (10 pages).
"Boiler (power generation)", www.wikipedia.org/wiki/Boiler_(power_generation), Mar. 2015 (10 pages).
"Boiler", www.wikipedia.org/wiki/Boiler, Mar. 2015 (10 pages).
"Gas flare", www.wikipedia.org/wiki/Gas_flare, Mar. 2015 (3 pages).
"Furnace", www.wikipedia.org/wiki/Furnace, Mar. 2015 (4 pages).
"Volumetric Heat Capacity", www.wikipedia.org/wiki/Volumetric_heat_capacity, Apr. 2015 (4 pages).
USPTO Office Action, U.S. Appl. No. 15/517,586, dated Apr. 5, 2018 (25 pages).
International Search Report and Written Opinion, PCT/US15/54668, dated Jan. 21, 2016 (13 pages).
International Search Report and Written Opinion, PCT/US15/54646, dated Mar. 4, 2016 (13 pages).
International Search Report and Written Opinion, PCT/US15/54650, dated Feb. 25, 2016 (16 pages).
International Preliminary Report on Patentability, PCT/US15/54650, dated Oct. 14, 2016 (4 pages).

* cited by examiner

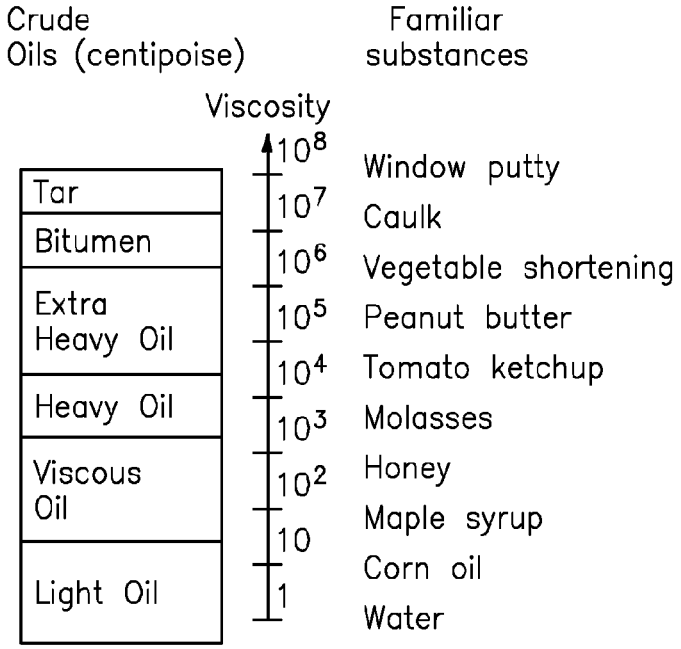
*FIG. 1(a)*
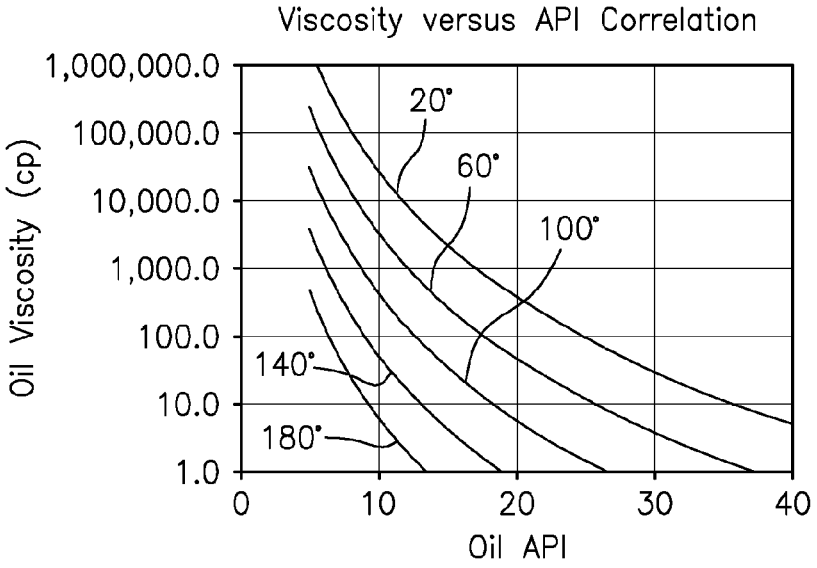
*FIG. (1b)*

GREEN BOILER—CLOSED LOOP ENERGY AND POWER SYSTEM TO SUPPORT ENHANCED OIL RECOVERY THAT IS ENVIRONMENTALLY FRIENDLY

BACKGROUND

Mature EOR (Enhanced Oil Recovery) processes include Steam Flooding (SF), Cyclic Steam Stimulation (CSS), Miscible Gas, Thermal, and Polymer Flooding. Less mature but demonstrated processes include SAGD (Steam Assisted Gravity Drain), Low Salinity Water-flooding, Alkaline-Surfactant-Polymer flooding, High Pressure Steam Injection, In-situ Combustion/HPAI (High Pressure Air Injection), and Pulsing Waves. Burning of fossil fuels (gas or diesel oil) to create heat for EOR is the typical approach for steam flooding, SAGD (Steam Assisted Gravity Drain) and in-situ-combustion (fire flooding that includes High Pressure Air Injection (HPIA)). When fossil fuel is burned for heat generation the exhaust is emitted into the atmosphere adding to pollution. Processes still undergoing research and development include In-situ Upgrading (heating), Crude Upgrading (catalytic), novel solvents, $N_2/CO_2$//ASP Foam, and Hybrid Processes. See "Advances in Enhanced Oil Recovery Processes," by Laura Romero-Zeron, University of New Brunswick, May 2012, at page 34 (adapted from Regtien, 2010).

Flaring gas is the burning of raw natural gas associated with oil extracted from an oil production well where there are no pipelines to carry the gas away. The process of flaring completely wastes the thermal energy produced, contaminates the atmosphere, and has other harmful effects. See the subsection "Impacts of waste flaring associated gas from oil drilling sites and other facilities," under "Gas flare," at the website Wikipedia, the free encyclopedia.

SUMMARY OF INVENTION

According to a first aspect of the present invention, a method comprises burning crude oil or natural gas extracted from an underground reservoir, or burning both crude oil and natural gas extracted from an underground reservoir, for providing thermal energy, transferring the thermal energy to brine separated from the extracted oil, gas, or both, for providing heated brine, or converting the thermal energy to mechanical work, or both transferring the thermal energy to the separated brine and converting the thermal energy to mechanical work, and heating the underground reservoir with the heated brine injected into the underground reservoir, or heating the underground reservoir with a resistive cable energized by electricity generated by converting the mechanical work to electric energy, or heating the underground reservoir with both the heated brine and the energized resistive cable.

In further accord with the first aspect of the present invention, the method may further comprise stimulating the underground reservoir with pressure waves propagated into the underground reservoir by stimulating the heated brine during injection while in an injection well. Further, the method may further comprise stimulating the underground reservoir with additional pressure waves propagated into the underground reservoir by stimulating the oil, gas, and brine while in a production well during extraction from underground, wherein the additional pressure waves are controlled such that the additional pressure waves propagate in phase with the pressure waves propagated into the underground reservoir by stimulating the heated brine during injection.

In still further accord with the first aspect of the present invention, the method may further comprise mixing exhaust gas from at least one of a heating source or vessel and a heat engine with the separated brine at least before, during, or after the transfer of thermal energy to the separated brine wherein the heated brine mixed with the exhaust gas is injected into the underground reservoir via one or more injection wells.

According to a second aspect of the present invention, an apparatus comprises means for burning crude oil or natural gas extracted from an underground reservoir, or for burning both crude oil and natural gas extracted from an underground reservoir, for providing thermal energy, means for transferring the thermal energy to brine separated from the extracted oil, gas, or both, for providing heated brine, or for converting the thermal energy to mechanical work, or for both transferring the thermal energy to the separated brine and converting the thermal energy to mechanical work, and means for heating the underground reservoir with the heated brine injected into the underground reservoir, or for heating the underground reservoir with a resistive cable energized by electricity generated by converting the mechanical work to electric energy, or for heating the underground reservoir with both the heated brine and the energized resistive cable.

In further accord with the second aspect of the present invention, the apparatus may further comprise means for stimulating the underground reservoir with pressure waves propagated into the underground reservoir by stimulating the heated brine during injection while in an injection well.

In still further accord with the second aspect of the present invention, the apparatus may further comprise means for stimulating the underground reservoir with additional pressure waves propagated into the underground reservoir by stimulating the crude oil, natural gas, and brine while in a production well during extraction from underground, wherein the additional pressure waves are controlled such that the additional pressure waves propagate in phase with the pressure waves propagated into the underground reservoir by stimulating the heated brine during injection.

In still further accord with the second aspect of the present invention, the apparatus may further comprise means for mixing exhaust gas from at least one of a heating vessel and a heat engine with the separated brine at least before, during, or after the transfer of heat from the heated fluid to the separated brine wherein the heated brine mixed with the exhaust gas is injected into the underground reservoir via one or more injection wells.

According to a third aspect of the present invention, an apparatus comprises

- one or more pumps for extracting crude oil, natural gas, and brine from one or more corresponding production wells in an underground reservoir;
- at least one separator for separating the extracted crude oil, natural gas, and brine for providing separated crude oil, natural gas, and brine;
- at least one heating device fueled by the separated crude oil, natural gas, or both, the heating device comprising at least one of a
  - a heating vessel for heating a fluid for providing heated fluid, or a heat source for generating thermal energy and a heat engine for converting the thermal energy to mechanical work;
- at least one of a heat exchanger and an electric generator, the heat exchanger for receiving the separated brine and the heated fluid for transferring heat from the heated fluid to the separated brine for providing heated brine, the generator for providing electricity and rotatable by a shaft of the heat engine coupled to a shaft of the generator, the heat engine comprising at least one of a turbine rotatable by thermal energy of a gas or vapor heated by the heat source moving through the turbine to act on blades attached to the shaft to move the blades and impart rotational energy to the shaft of the heat engine or an internal combustion engine for converting chemical energy of one or more of diesel, the extracted crude oil, or the extracted natural gas to the mechanical work for imparting rotational energy to the shaft of the heat engine; and at least one of an injection pump and an electric heating cable, the injection pump for injecting the heated brine into one or more injection wells in the underground reservoir to transfer heat to unrecovered crude oil in the reservoir so as to reduce viscosity of the unrecovered crude oil and enhance flow of the unrecovered crude oil to the one or more production wells, the electric heating cable heated by the electricity provided by the generator and located in at least one of the one or more heat delivery wells, the one or more production wells, or the one or more injection wells for heating the underground reservoir.

In further accord with the third aspect of the present invention, the apparatus may further comprise a stimulator for stimulating the underground reservoir with pressure waves propagated into the underground reservoir by stimulating the heated brine during injection. The apparatus may further comprise an additional stimulator for stimulating the underground reservoir with additional pressure waves propagated into the underground reservoir by stimulating the oil, gas, and brine during extraction from the underground reservoir, wherein the additional pressure waves are in phase with the pressure waves propagated into the underground reservoir by stimulating the heated brine during injection. The stimulator, the additional stimulator or both may comprise a self-powered device for inducing modulation in a flowing fluid stream.

In still further accord with the third aspect of the present invention, the apparatus may further comprise a mixer for mixing exhaust gas from at least one of the heating vessel and the heat engine with the separated brine at least before, during, or after the transfer of heat from the heated fluid to the separated brine wherein the injection pump is for injecting the heated brine mixed with the exhaust gas into the one or more injection wells. The apparatus including the mixer may further comprise a stimulator for stimulating the underground reservoir with pressure waves propagated into the underground reservoir by stimulating the heated brine mixed with the exhaust gas in the one or more injection wells. The apparatus including the mixer may further comprise an additional stimulator for stimulating the underground reservoir with additional pressure waves propagated into the underground reservoir by stimulating the oil, gas, and brine during extraction from the underground reservoir, wherein the additional pressure waves are controlled in phase with the pressure waves propagated into the underground reservoir by stimulating the brine mixed with the exhaust gas during injection. The stimulator, the additional stimulator or both may comprise a self-powered device for inducing modulation in a flowing fluid stream.

Still further in accord with the third aspect of the present invention, the heated fluid may include steam, the turbine comprising a steam turbine, responsive to the steam from the heating vessel to operate a generator to provide electricity, and the apparatus comprising at least one electric heating cable, responsive to the electricity, for providing additional heat to the underground reservoir via the one or more production wells, the one or more injection wells, or one or more separate heat delivery wells, or via any combination of the production, injection, and heat delivery wells.

In accordance still further with the third aspect of the present invention, the heating vessel comprises a plurality of heating vessels, each for heating a portion the heated fluid provided to the heat exchanger and for receiving from the heat exchanger a corresponding cooled portion of the fluid circulating between the at least one heat exchanger and the plurality of heating vessels.

In further accord with the third aspect of the present invention, the one or more corresponding production wells comprise a plurality of production wells for providing crude oil, natural gas, and brine extracted from the underground reservoir to the one or more separators for separating the extracted crude oil, natural gas, and brine for providing separated crude oil, natural gas, or both, to at least one corresponding manifold, each manifold comprising a plurality of oil or gas outlets for providing fuel for burning in a plurality of heating vessels and a heat source or for burning in pluralities of both heating vessels and heat sources.

BRIEF DESCRIPTION OF THE DRAWINGS

FIG. 1(*b*) shows crude oil viscosity vs. API (American Petroleum Institute) gravity curves for five temperatures.

FIG. 1(*c*) shows pulse pressure required to move oil from different size pores with a pressure wave at a given frequency and propagation speed in a tight reservoir at various temperatures.

FIG. 1(*d*) shows a longitudinal sound wave propagating in air and having a sinusoidal form with pressure peaks and troughs shown in relation to atmospheric pressure.

FIG. 1(*e*) is in alignment with FIG. 1(*d*) to show the wave of FIG. 1(*d*) causing air particle displacement parallel to the direction of propagation, left to right in the Figure, with rarefactions and compressions of air molecules corresponding to the decreased pressure and increased pressure, respectively, as compared to atmospheric pressure in FIG. 1(*d*).

FIG. 1(*f*) shows destructive interference caused when waves meet out-of-phase.

FIG. 1(*g*) shows constructive interference caused when waves meet in-phase.

DETAILED DESCRIPTION

In petroleum geology, a reservoir is a porous and permeable lithological unit or set of units in a formation that hold hydrocarbon reserves such as crude oil and natural gas. The flow rate (Q) of the hydrocarbon reserves through such a formation may be determined according to Darcy's Law:

$$Q = \frac{\kappa A}{\mu} \cdot \frac{\partial p}{\partial x}$$

where Q is the flowrate (in units of volume per unit time), κ is the relative permeability of the formation (typically in millidarcies), A is the cross-sectional area of the formation, μ is the viscosity of the fluid (typically in units of centipoise), and ∂p/∂x represents the pressure change per unit length of the formation that the fluid will flow through.

Figure 1C:
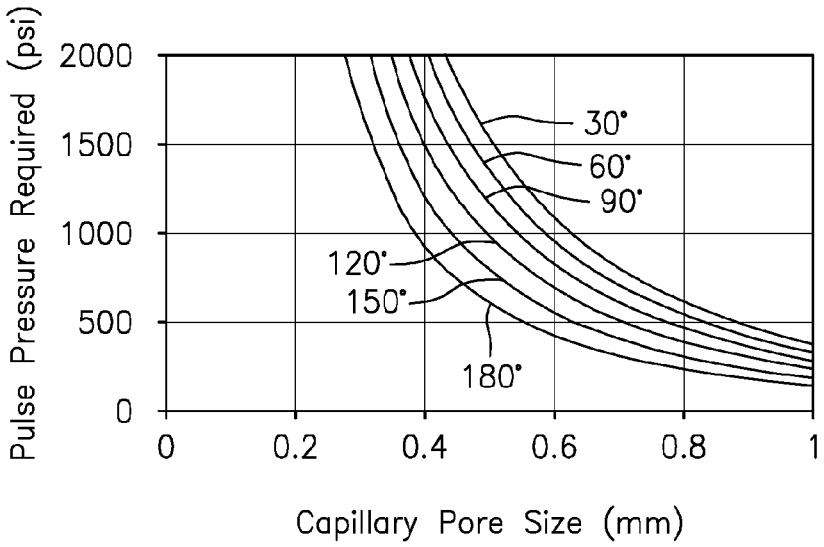
FIG. 1(*a*) shows viscosities of various types of crude oil as compared to familiar substances.
Figure 1D:
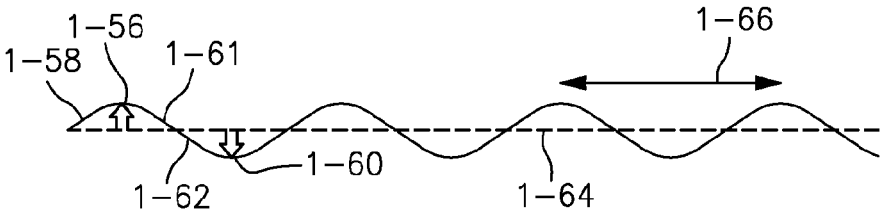
Figure 1E:
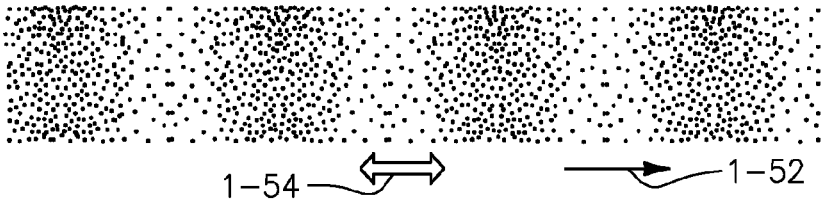
Figure 1F:
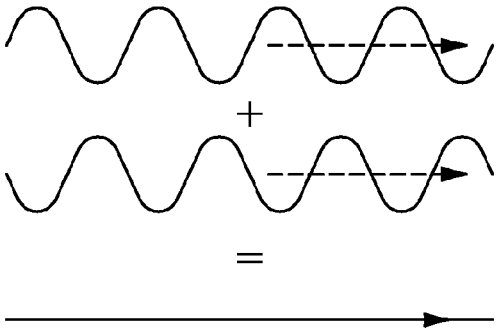
Figure 1G:
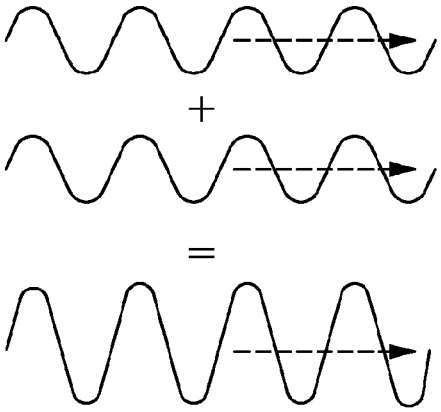

Crude oil viscosity (κ) is its resistance to flow. It may be viewed as a measure of its internal friction such that a force is needed to cause one layer to slide past another. Newton's law of viscosity states that the shear stress between adjacent fluid layers is proportional to the negative value of the velocity gradient between the two layers. Alternatively, the law may be interpreted as stating that the rate of momentum transfer per unit area, between two adjacent layers of fluid, is proportional to the negative value of the velocity gradient between them. The unit of viscosity in cgs units is dyne·sec/$cm^2$ (1 dyne-sec/$cm^2$ is called a poise (P)). From the units, it will be evident that viscosity has dimensions of momentum per unit area. One Poise (P) in mks units is 0.1 $kg \cdot m^{-1} \cdot s^{-1}$. The SI unit for viscosity is the pascal·second (Pa·s) which equals 10P. A centipoise is one-hundedth of a poise and one millipascal·second (mPa·s). FIG. 1*a* shows (on the left hand side) various types of crude oil with viscosities indicated on a vertical logarithmic scale in centipoise as compared to familiar substances on the right hand side aligned along the same scale.

API (American Petroleum Institute) gravity is an inverse measure of the relative density, as compared to water, of crude oil. It is measured in units called API degrees (°API). The lower the number of API degrees, the higher the specific gravity of the oil. If greater than 10, the oil floats. If less than 10, it sinks. FIG. 1*b* shows a correlation between crude oil viscosity (cp) versus API gravity for five different temperatures (five curves, from left to right, at 180 C, 140 C, 100 C, 60 C, and 20 C). For a given temperature curve, e.g., the top curve at 20 C, it is clear that a light crude with API>30 will have a viscosity much lower than a heavy crude with API<22. The ratio of fluid viscosity to density is called kinematic viscosity and is indicative of the ability of the fluid to transport momentum. It has dimensions of $L^2T^{-1}$. It is also referred to as the momentum diffusivity of the fluid.

The permeability to flow through a rock for the case where a single fluid is present is different when other fluids are present in the reservoir. Saturation, the proportion of oil, gas, water and other fluids in a rock is a crucial factor in a pre-development evaluation of the reservoir. The relative saturations of the fluids as well as the nature of the reservoir affect the permeability. Crude oil mobility ($\lambda_0$) is the ratio of the effective permeability ($\kappa_0$) to the oil flow to its viscosity ($\mu_0$):

$$\lambda_0 = \kappa_0 / \mu_0$$

The effective permeability characterizes the ability of the crude oil to flow through the rock material of the reservoir. As will be evident from the above-mentioned Darcy's Law, permeability should be affected by pressure in the rock material. The millidarcy also mentioned above in connection with the typical unit used for permeabily (κ) is related to the basic unit of measure, i.e., the darcy ($m^2$) in the mks system and $cm^2$ in the cgs system. The darcy is referenced to a mixture of unit systems. A medium with a permeability of 1 darcy permits a flow of 1 $cm^3$/s of a fluid with viscosity 1 cP (1 mPa·s) under a pressure gradient of 1 atm/cm acting across an area of 1 $cm^2$. A millidarcy (md) is equal to 0.001 darcy. Rock permeability is usually expressed in millidarcys (md) because rocks hosting hydrocarbon or water accumulations typically exhibit permeability ranging from 5 to 500 md.

Thus, the principle used herein is that heat applied to a reservoir increases its permeability and reduces the viscosity of the crude oil to increase the oil mobility. In other words, lowering oil viscosity with heat increases the flow rate of the oil. Heating methods include cyclic steam injection, steam flooding and fire flooding. For cyclic steam injection, steam may first be injected into a well for a few days or weeks. Then the heat may then be allowed to dissipate into the reservoir for a few days to reduce oil viscosity. Finally, the production begins with improved flow rate. The three step process is then repeated e.g. after the flow rate diminishes. Steam flooding is where some wells are used for injecting steam and others for oil production. The steam flood acts to both heat the reservoir and push the oil by displacement toward the production wells. Fire flooding is where combustion generates heat within the reservoir itself.

TABLE 1

| Composition by Weight | | | |
|---|---|---|---|
| Hydrocarbon | Average | Range | Melting or Liquification Point |
| Paraffins | 30% | 15 to 60% | 115° F. to 155° F. (46° C. to 68° C.) |
| Naphthenes | 49% | 30 to 60% | |
| Aromatics | 15% | 3 to 30% | |
| Asphaltenes | 6% | Remainder | 180° F. (82° C.) |
| Karogen | | 842° F. to 932° F. (450° C. to 500° C.) | |

It should be realized that the viscosity is affected by temperature, pressure, and by composition. Among others, the following conditions impact oil flow rate:

1) Crude oils contain substantial proportions of saturated and aromatic hydrocarbons with relatively small percentages of resins and asphaltenes and other substances as listed in Table 1. More degraded crude oils contain substantially larger proportions of resins and asphaltenes. Heavy crude oil (API<22) occurs when the oil contains paraffin and/or asphaltenes and the temperature of the oil reservoir is too low. See Table 1 above for melting or liquification points and see also FIG. 1*b*. As oil is heated the viscosity lowers and the efficiencies of flow increase.
2) Crude oil (including light crude oil API>30) viscosity increases as it cools due to one or more of the following conditions:
   a) the oil reservoir is shallow and the temperature of the reservoir is low;
   b) it is heavy crude oil (API<22);
   c) the oil reservoir is deep and the oil cools as it is pumped out of the well;
   d) the ambient temperature is extremely cold and the oil cools quickly as it is exposed to the cold near or at the surface; and
   e) any set of conditions where the oil cools and the viscosity increases and this adversely effects the efficiency of the oil flow in a production well.

As will be appreciated from the foregoing, heating the reservoir to remove barriers to the flow of fluids into a well will tend to lower the viscosity of the fluids so that the existing permeability will allow the oil to flow with an increased rate and hence increased volume to the production wells. An important teaching hereof is to burn crude oil or natural gas extracted from an underground reservoir (or burn both crude oil and natural gas extracted from the underground reservoir), in order to provide thermal energy. In other words, the teaching is to supply the necessary power and materials from the reservoir itself to mobilize the oil and move it to the production wells. A heat source fed by fuel produced from the reservoir accomplishes the production of heat. It does so in such a way, as shown below, as to allow enhanced oil recovery that is environmentally benign.

Thus a method is disclosed herein, in that crude oil or natural gas extracted from an underground reservoir is burned for providing thermal energy. Or, both crude oil and natural gas extracted from an underground reservoir is burned, for providing thermal energy. The thermal energy is transferred to brine separated from the extracted oil, gas, or both, for providing heated brine. Or, the thermal energy is converted to mechanical work. Or, the thermal energy is both transferred to the separated brine and converted to mechanical work. The underground reservoir is heated with the heated brine by injection into the underground reservoir. Or the underground reservoir is heated with a resistive cable energized by electricity generated by converting the mechanical work to electric energy. Or, the underground reservoir is heated with both heated brine and heat from an energized resistive cable.

For instance, a "Green Boiler" may be provided to burn natural gas, crude oil, or both, produced from a reservoir. The boiler may be used to heat a flow of water that circulates in a closed loop out of a heat exchanger in a cooled condition and return a flow of heated water into the heat exchanger in order to transfer heat from the heated water to the brine pumped from a production well and injected back into the reservoir after gaining heat and flowing out of the heat exchanger. As such, the Green Boiler is a closed loop system that uses the resources of an oil and gas reservoir to enhance the extraction of oil and gas. The system eliminates any flaring gas and eliminates any negative emissions of any pollutants into the atmosphere. The byproducts may thus be used in the enhancement process. The heat exchanger may be any type that will transfer heat efficiently from the heated water to the brine such as a counter-flow heat exchanger where the fluids enter the exchanger from opposite ends.

In addition to the use of hydrocarbons extracted from the reservoir, according to the teachings hereof, additional conditioning of the reservoir may be added. Rather than choosing merely to add a single legacy EOR process from among the EOR processes mentioned in the background section, according further to the teachings hereof, it is advantageous to employ a comprehensive approach. Such a comprehensive approach may include adding:

Thermal flooding plus
Thermal water (Brine) flooding plus
Thermal $CO_2$ flooding plus
Thermal Nitogen flooding plus
Synchronized wave pulses plus
optional additives.

Legacy EOR processes are well understood and in-field implementations have proved their effectiveness. In combining known approaches, several of the aforementioned background processes may be employed including Steam (Steam Flooding (SF) and/or Cyclic Steam Stimulation (CSS)),
Miscible Gas,
Thermal,
SAGD (Steam Assisted Gravity Drain),
Low Salinity Water-flooding, High Pressure Steam Injection, and
Pulsing Waves.

For a comprehensive approach, no fresh water is needed, no external gases or chemicals are needed, and no greenhouse gases are needed, released or flared. An integrated process combines field proven legacy EOR processes and controls their synergistic interaction to achieve higher overall extraction rates yielding increase bookable oil reserves. An example of a "Comprehensive EOR System" is more fully disclosed in co-pending U.S. Provisional Patent Application Ser. No. 62/061,462 filed Oct. 8, 2014 and is hereby incorporated by reference. An example of "Pulsing Pressure Waves Enhancing Oil & Gas Extraction in a Reservoir" is more fully disclosed in co-pending U.S. Provisional Patent Application Ser. No. 62/061,448 filed Oct. 8, 2014 and is hereby incorporated by reference. An example of a "GTherm Enhanced Oil Recovery 'Thermally Assisted Oil Production Wells'" is more fully disclosed in co-pending U.S. Provisional Patent Application Ser. No. 62/061,437 filed Oct. 8, 2014 and is hereby incorporated by reference. An example of "GTherm Enhanced Oil Production" is more fully disclosed in co-pending U.S. Provisional Patent Application Ser. No. 62/061,426 filed Oct. 8, 2014 and is hereby incorporated by reference. An example of "Enhanced Oil Production" is more fully disclosed in co-pending U.S. Provisional Patent Application Ser. No. 62/061,420 filed Oct. 8, 2014 and is hereby incorporated by reference.

FIGS. 1(*d*) and 1(*e*) show an example of longitudinal sound wave produced in air, e.g., by a vibrating tuning fork, as known. A wave is a disturbance or variation which travels through a medium. The medium in the example of FIGS. 1(*d*) and 1(*e*) is air through which the disturbance or sound or pressure wave travels. The pressure of a sinusoidal pressure wave is shown plotted versus time in the top FIG. 1(*d*) propagating 1-52 from left to right. If FIGS. 1(*d*) and 1(*e*) were animated, the impression would be that the regions of compression travel from left to right. In reality, although the air molecules experience some local oscillations as the pressure wave passes, the molecules do not travel with the wave. As the tines of the fork vibrate back and forth, they push on neighboring air molecules. The forward motion of a tine pushes air molecules horizontally to the right to create a high-pressure area and the backward retraction of the tine to the left to create a low-pressure area allowing the air molecules to move back to the left. As shown in the plot of displacement in the bottom half in FIG. 1(*e*), because of the longitudinal motion 1-54 of the air molecules, there are regions where the air molecules are compressed together and other regions where the air molecules are spread apart. These regions are known as compressions and rarefactions respectively. The compressions are regions of high air pressure while the rarefactions are regions of low air pressure. At the far left of FIG. 1(*e*) an increased pressure compression is depicted corresponding to a peak 1-56 in FIG. 1(*d*) following an up amplitude 1-58. A decreased pressure rarefaction corresponding to a trough 1-60 then follows a down amplitude 1-61. The maximum distance (the peak or trough) that a molecule of the air moves away from its rest position (see horizontal line 1-64 in FIG. 1(*d*)) is the amplitude. As such, this may be understood as the amplitude of the movement of an air molecule caused by the pressure wave as it propagates through the air, i.e., sinusoid in the figure represents the extremes of the horizontal molecule displacement amplitude of the air molecules as the pressure wave moves. As will be apparent, it may also be seen as representative of the pressure amplitude of the wave as it propagates through the air. The wavelength 1-66 of such a wave is the distance that the wave travels in the air in one complete wave cycle. The wavelength is commonly measured as the distance from one compression to the next adjacent compression or the distance from one rarefaction to the next adjacent rarefaction.

Likewise, excitation of a reservoir with a pressure wave results in a repeating pattern of high-pressure and low-pressure regions moving through the oil reservoir and can enhance oil recovery by causing movement in the walls of a pore of a particle of rock so as to induce movement and flow of oil, gas and water out of the pore. It also breaks the surface tension of the oil and water. To cause pressure waves characterized by cycles of low and high pressure, pumps or other forms of transducers may be used. The length of one cycle (wavelength) and the number of times the cycle repeats itself per unit time defines the pressure wave's frequency. The velocity of the wave depends on the medium but is defined as the frequency times the wavelength. FIG. 1(*c*) shows an example of the pulse pressure (psi) required for oil movement at different temperatures versus capillary pore size (mm) when using a pressure wave frequency of 20 Hz in a formation where the wave propagation velocity is 2000 m/s corresponding to a wavelength of one hundred meters. Different curves would result for a different formation with a different propagation velocity and a different selected frequency but it should be clear that thermal conditioning of the reservoir will result in less pressure wave pressure required for the same enhancement in oil movement.

Wave interference is the phenomenon that occurs when two waves meet while traveling along the same medium. The interference of waves causes the medium to take on a shape that results from the net effect of the two individual waves upon the particles of the medium. Consider two pulses of the same amplitude traveling in different directions along the same medium. Let us suppose that each is displaced upward one unit at its crest and has the shape of a sine wave. As the sine pulses move towards each other, there will eventually be a moment in time when they are completely overlapped. At that moment, the resulting shape of the medium would be an upward displaced sine pulse with amplitude of two units. This is constructive interference as shown in FIG. 1(*g*). On the other hand, FIG. 1(*f*) depicts the results when two equal waves meet that are 180° out of phase. When the out of phase waves meet the compression and rarefactions overlay and the resultant wave has zero compression and rarefaction (the waves cancel each other with destructive interference). If two waves meet "in phase" the compression is additive and the rarefaction is additive as in FIG. 1(*g*). According to the teachings hereof, constructive wave interference, such as shown in FIG. 1(*g*), can be used to enhance oil and gas recovery by increasing flow. Such may be done with conditioning before or at the same time, or following conditioning. The constructive interference may be of pressure waves caused by a device such as shown in U.S. provisional application Ser. No. 62/120,599 filed Feb. 25, 2015 entitled "Self-Powered Device to Induce Modulation in a Flowing Fluid Stream." The device may be used in conjunction with vertical slots arranged for instance at selected vertical intervals around the periphery of the well bore. The slots may be of fixed length to match a selected wavelength to correspond with the desired wavelength for the pressure waves or may have adjustable length to provide for adjustable wavelength.

TABLE 2

| Legacy EOR Techniques | API Required | Expected Extraction |
|---|---|---|
| Thermal Flooding (Steam) | 5-40+ | 20.0% |
| Water Flooding (Brine) | 30+ | 16.0% |
| $CO_2$ Flooding | 30+ | 20.0% |
| $N_2$ Flooding | 30+ | 12.6% |
| Pulsing Waves | 30+ | 15.0% |

In Table 2, when using legacy EOR processes individually, expected extraction percentages are shown for different APIs Required (excluding heavy crude oil in all but the top row). As may be seen in Table 3, when a comprehensive approach is taken, even assuming a conservative Expected Extraction of 50% for each process and including heavy crude oil, the system extracts over two times the result of any one legacy system taken alone.

TABLE 3

| Comprehensive EOR System | API Required | Expected Extraction | Cumulative Effect |
|---|---|---|---|
| Thermal Flooding (Steam) | 5-40+ | 10.0% | 10.0% |
| Water Flooding (Brine) | 5-40+ | 8.0% | 18.8% |
| $CO_2$ Flooding | 5-40+ | 10.0% | 30.7% |
| $N_2$ Flooding | 5-40+ | 6.3% | 38.9% |
| Pulsing Waves | 5-40+ | 7.5% | 49.3% |

Figure 2:
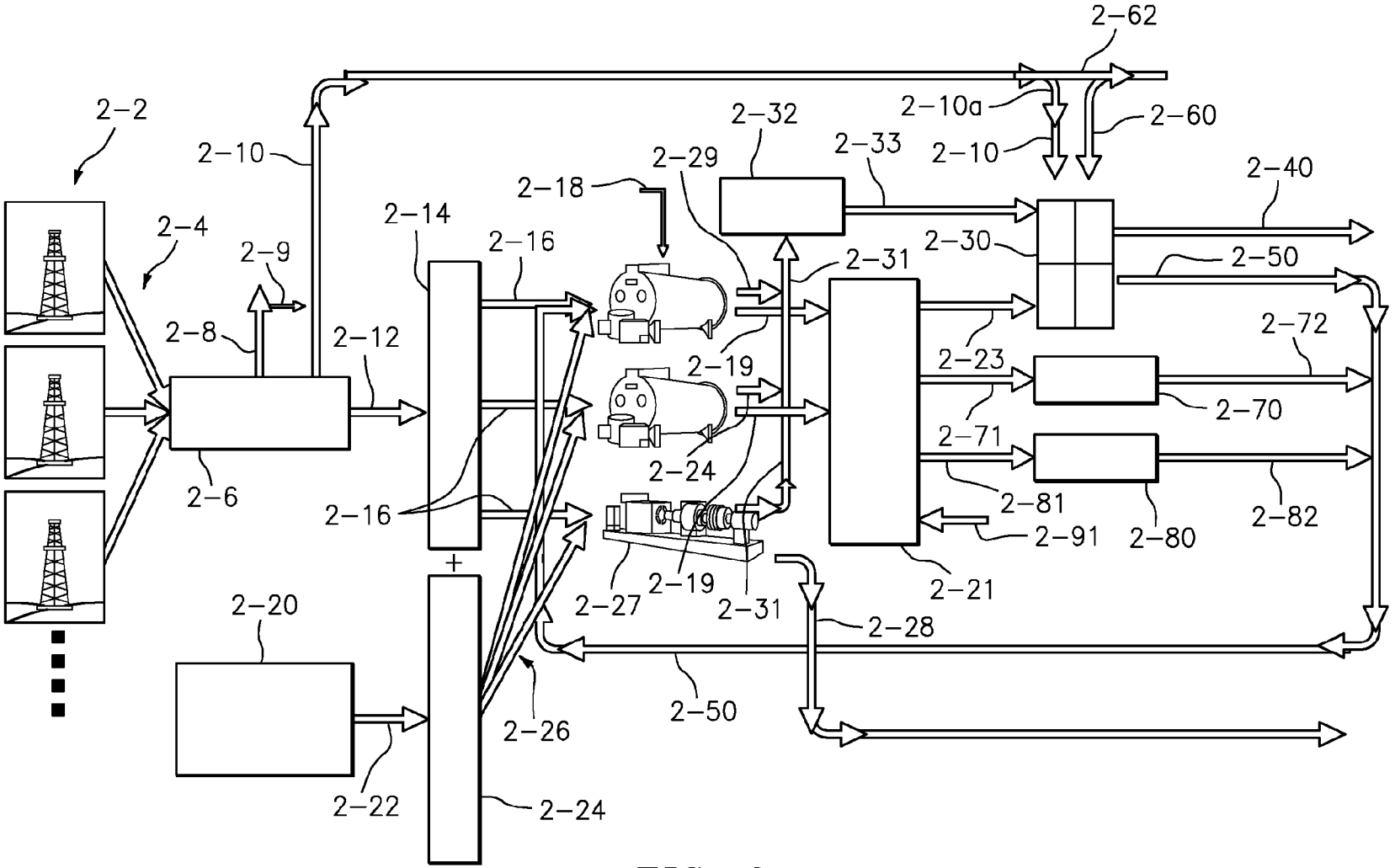
FIG. 2 shows an embodiment of a Green Boiler System according to the teachings hereof.

FIG. 2 shows a system and method according to the teachings hereof. One or more oil wells 2-2 are pumped to produce a fluid mixture 2-4 that may include crude oil, natural gas, and brine. The pumped fluid is provided to a separator 2-6 that represents a pressure vessel that separates the different well fluids into their constituent components of oil, gas and water/brine and that provides separate flows of crude oil 2-8, brine 2-10, and natural gas 2-12. Separators work on the principle that the three components have different densities, which allows them to stratify when moving slowly with gas on top, water on the bottom and oil in the middle. Solids settle in the bottom of the separator. If there are more than one well used and the volume of recovered hydrocarbons is large, a plurality of heat sources may be employed in the system, as in FIG. 2. In such a case, the natural gas may be provided from an outlet of the separator to an inlet of a manifold 2-14 and split by the manifold into a plurality of natural gas stream outlets provided in piping connected to the plurality of heat sources, in this case, one or more "green boilers" 2-18. Other types of heat sources such as furnaces may be used as well. It should be realized that some 2-9 of the crude oil 2-8 separated by the separator 2-6 may be used to fuel the heat source either alone or in combination with natural gas. There are boilers that can burn both types of fuel. If in some cases the hydrocarbon recovery volume is low and additional fuel is needed, e.g., crude oil and/or diesel 2-20, it may be supplied 2-22 via another manifold 2-24 to the plurality of heat sources via separate fuel feed pipe lines 2-26. In any event, according to the teachings hereof, the system of FIG. 2 is able to carry out a method of burning crude oil or natural gas extracted from an underground reservoir, or burning both crude oil and natural gas extracted from an underground reservoir, for providing thermal energy.

The natural gas 2-16 supplied by the manifold 2-16 may also be supplied to one or more gas, crude oil, or diesel fueled heat engines such as a gas turbine generator 2-27 that provides electricity 2-28. The electricity output from the generator may be connected to an electric resistant cable that is used to produce heat for heating a thermally assisted oil well. The electricity may be used for other purposes as well.

The separated brine 2-10 from the separator 2-6 may be provided to a heat exchanger/mixer 2-30 to be heated. Although shown as a combined heat exchanger/mixer 2-30, it should be realized the heat exchanger and mixer could be separate. The thermal energy provided by the boilers 2-18 may be transferred to a fluid such as water circulating in a closed loop through the boilers and the heat exchanger. Heated water is shown being provided on one or more pipe lines 2-19 from outlets of the boilers 2-18 to at least one inlet of a hot water manifold 2-21. An outlet of the hot water manifold provides hot water on a line 2-23 to an inlet of a heat exchanger part of the heat exchanger/mixer 2-30 or to a separate heat exchanger.

Hot exhaust gases from the one or more heat engines such as exhaust 2-29 from the plurality of gas boilers 2-18 and/or exhaust gases 2-31 from a gas turbine of the turbine generator 2-27 are provided to an exhaust scrubber 2-32. Scrubbed exhaust gases containing e.g. $CO_2$ and $N_2$ are then provided on a line 2-33 to the mixer part of the heat exchanger 2-30 or to a separate mixer. The mixer performs a mixing of the scrubber exhaust gas 2-33 from the scrubber 2-32 (fed by at least one of a heating vessel e.g. boiler(s) 2-18 and a heat engine e.g. a turbine of turbine generator 2-27) with the separated brine at least before, during, or after the transfer of thermal energy to the separated brine, wherein hot brine on the line 2-40 mixed with the exhaust gas 2-33 is injected into the underground reservoir via one or more injection wells. A mixer may have a series of fixed, geometric elements enclosed within a housing. The fluids to be mixed are fed at one end and the internal elements impart flow division to promote radial mixing while flowing toward the other end. Simultaneous heating can be done if the mixer is inside the heat exchanger.

The heat exchanger is thus for transferring the thermal energy produced in e.g. the boilers 2-18 to the separated brine 2-10, for providing heated brine on the line 2-40, or for converting the thermal energy to mechanical work for instance by a turbine part of the turbine generator 2-27, or (as in FIG. 2) for both transferring the thermal energy to the separated brine as shown in the heat exchanger 2-30 and converting the thermal energy to mechanical work as shown in the turbine part of the turbine generator 2-27.

The system of FIG. 2 then continues the process by heating the underground reservoir with the heated brine on the line 2-40 by injecting it into the underground reservoir. Or the system continues the process by heating the underground reservoir with a resistive cable energized by electricity 2-28 generated by converting mechanical work to electric energy. Or the system continues the process by heating the underground reservoir with both the heated brine and the energized resistive cable.

Cooled circulating water on a line 2-50 that is shown circulating out of an outlet of the heat exchanger/mixer 2-30 is returned to the boilers 2-18 for re-heating and for again being fed into the hot water manifold 2-21 on lines 2-19 for heating more brine produced on an on-going basis by the wells 2-2. It should be mentioned that if viscosity reducing additives are used for instance as shown on a line 2-60 for mixture in a mixer (not shown) with the extracted brine 2-10, there will need to be an additive separator (also not shown) as signified by the brine being sent on a line 2-62 to such an additive separator before it is returned on a line **2-10*a* to the heat exchanger/mixer 2-30**.

Figure 3:
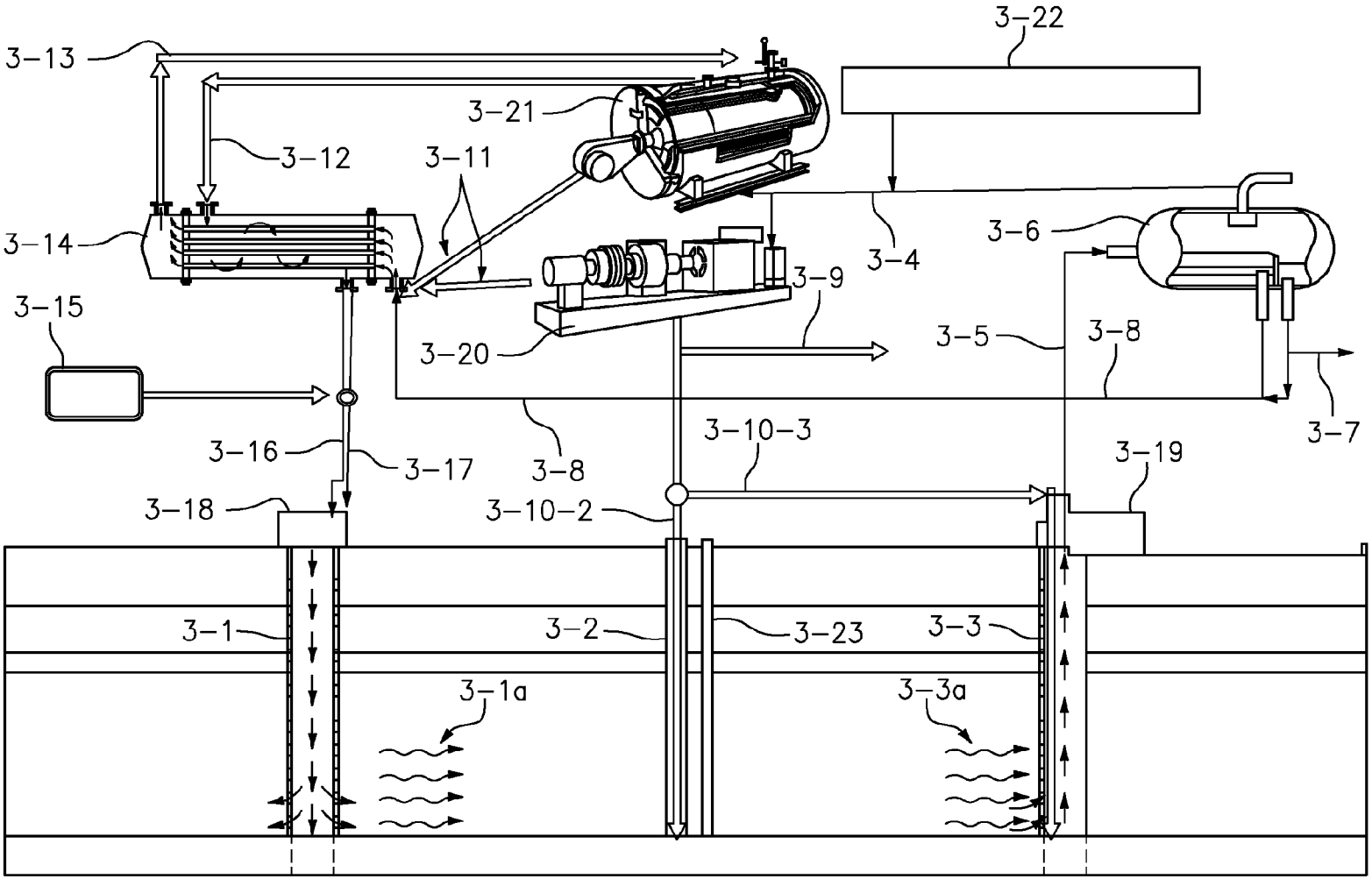
FIG. 3 shows another embodiment of Green Boiler System and how it interfaces and supports a comprehensive enhanced oil recovery system.

Another exemplary "Green Boiler" System is shown in detail in FIG. 3. Though shown vertically, all wells depicted are horizontal. It should be realized that the wells do not need to be horizontal. For the case where horizontal wells are used, the heat delivery wells may be at right angles relative to the injector and the producer wells or may be implemented in a parallel or angular formation. The system works as follows:

1. One or more producer wells 3-3 deliver oil, gases and brine (water) on a line 3-5 (which may contain other elements) to at least one separator 3-6.
2. The at least one separator 3-6 separates the oil and provides separated oil on a line 3-7, provides separated gas on a gas line 3-4, and provides separated brine on a brine line 3-8. The separated brine may include optional additives and/or optional oil. The separated brine with or without the optional additives and/or crude oil is sent on the line 3-8 to an inlet of at least one heat exchanger/mixer 3-14. If additives have been used they are separated from the brine. The oil 3-7 (less any oil used for fluid injection 3-8 and any oil that may be used for thermal generation 3-4) is sent on the line 3-7 to a pipeline or a storage tank as recovered crude oil. The gas 3-4 and/or any oil used for thermal generation is sent on the line 3-4 to one or more boilers 3-21 for generation of thermal energy and may also be sent on the line 3-4 to one or more heat engines connected to an electric generator, such as one or more turbine generators 3-20 for generation of electricity on a line 3-9. The turbines of the one or more turbine generators 3-20 may be gas turbines. A gas turbine derives its power from burning fuel such as the gas or crude oil on the line 3-4 in a combustion chamber and using the fast flowing combustion gases to drive a turbine in a manner similar to the way high pressure steam drives a steam turbine. The difference is that the gas turbine has a second turbine acting as an air compressor mounted on the same shaft. The air turbine (compressor) draws in air, compresses it and feeds it at high pressure into the combustion chamber to increase the intensity of the burning flame. The pressure ratio between the air inlet and the exhaust outlet is maximized to maximize air flow through the turbine. High pressure hot gases are sent into the gas turbine to make it spin the turbine shaft at a high speed connected via a reduction gear to the generator shaft. In the alternative, the one or more turbine generators 3-20 may include one or more steam turbines. In that case, the one or more boilers 3-21 may include one or more steam boilers. Or, exhaust gases from a gas turbine may be supplied to a heat exchanger that produces steam fed to a steam turbine connected to another electric generator (electricity co-generation).
3. Exhaust 3-11 from the boiler(s) 3-21 and turbine(s) of the turbine generator 3-20 (or other heat engine) is also sent on a line 3-11 e.g. to an inlet of the heat exchanger/mixer 3-14, which may be the same inlet as used by the separated brine on the line 3-8 (as shown).
4. The hot water on the line 3-12 from the closed loop boiler 3-21 and the cooled water on the line 3-13 from the heat exchanger/mixer 3-14 is cycled. The hot water on the line 3-12 from the boiler 3-21 is provided to another inlet of the heat exchanger/mixer 3-14. The heat exchanger/mixer 3-14 uses the heat from the hot water 3-12 to heat the brine or brine/oil mixture on the line 3-8 before, during, or after mixing the brine or brine-oil mixture with the exhaust 3-11. Thus, the mixer may mix the exhaust into the brine or brine-oil mixture before, during, or after the heat transfer. Once the heat exchange has occurred the cooled water on the line 3-13 is sent back from the heat exchanger 3-14 to the boiler 3-21 for re-heating.

5. The heated brine/oil mixture 3-8 may be mixed with the exhaust 3-11 and then optionally mixed with additional additives 3-15 and sent to one or more injection pumps 3-18.
6. The injection pumps 3-18 inject the combined mixture into one or more injection wells 3-1 which may include one or more oscillating devices 3-18 that create pressure waves for the enhanced oil extraction system. In other words, any of the methods shown herein may include stimulating the underground reservoir with pressure waves propagated into the underground reservoir by stimulating the heated brine during injection in an injection well 3-1.
7. The one or more injection wells 3-1 inject heated brine and/or oil, hot exhaust gases such as $CO_2$, $N_2$ and other gases, and optionally additives into the oil & gas reservoir. Electricity 3-9 for the injection pump or pumps may be provided by the electric generator of the Turbine Generator 3-20.
8. The heat delivery well 3-2 radiates heat into the reservoir using either electricity generated from the generator of the turbine generator 3-20 (as shown) and/or water heated by the boiler and circulated in a closed loop (see e.g. FIG. 4 into and out of a heat delivery well 4-2*b*).
9. One or more producer well pumps pulsing oscillators 3-19, and electric heating cables 10 may be powered by the generator of the turbine generator 3-20. The one or more pulsing oscillators 3-19 are used to stimulate the underground reservoir with additional pressure waves 3-3*a* that are propagated into the underground reservoir. The oil, gas, and brine mixture in a given production well 3-3 is stimulated during extraction from underground. The additional pressure waves 3-3*a* are controlled such that the additional pressure waves 3-3*a* are at the same frequency and are synchronized to propagate "in phase" with the pressure waves 3-1*a* that are separately propagated into the underground reservoir by stimulation of the heated brine during injection into the well 3-1. When the "in phase" pressure waves 3-3*a* meet the pressure waves 3-1*a* in the reservoir between the two wells, they interfere constructively as shown in FIG. 1(*g*). The amplitude of vibratory stimulation of the reservoir by pressure waves is thus increased in order to increase vibration in the pores of the reservoir, increase mobility of the crude oil, and enhance flow rate.
10. One or more monitor wells 3-23 may be employed to provide control information to a control system that controls the operations of a given system such as the Green Boiler System shown in FIG. 3.

Figure 4:
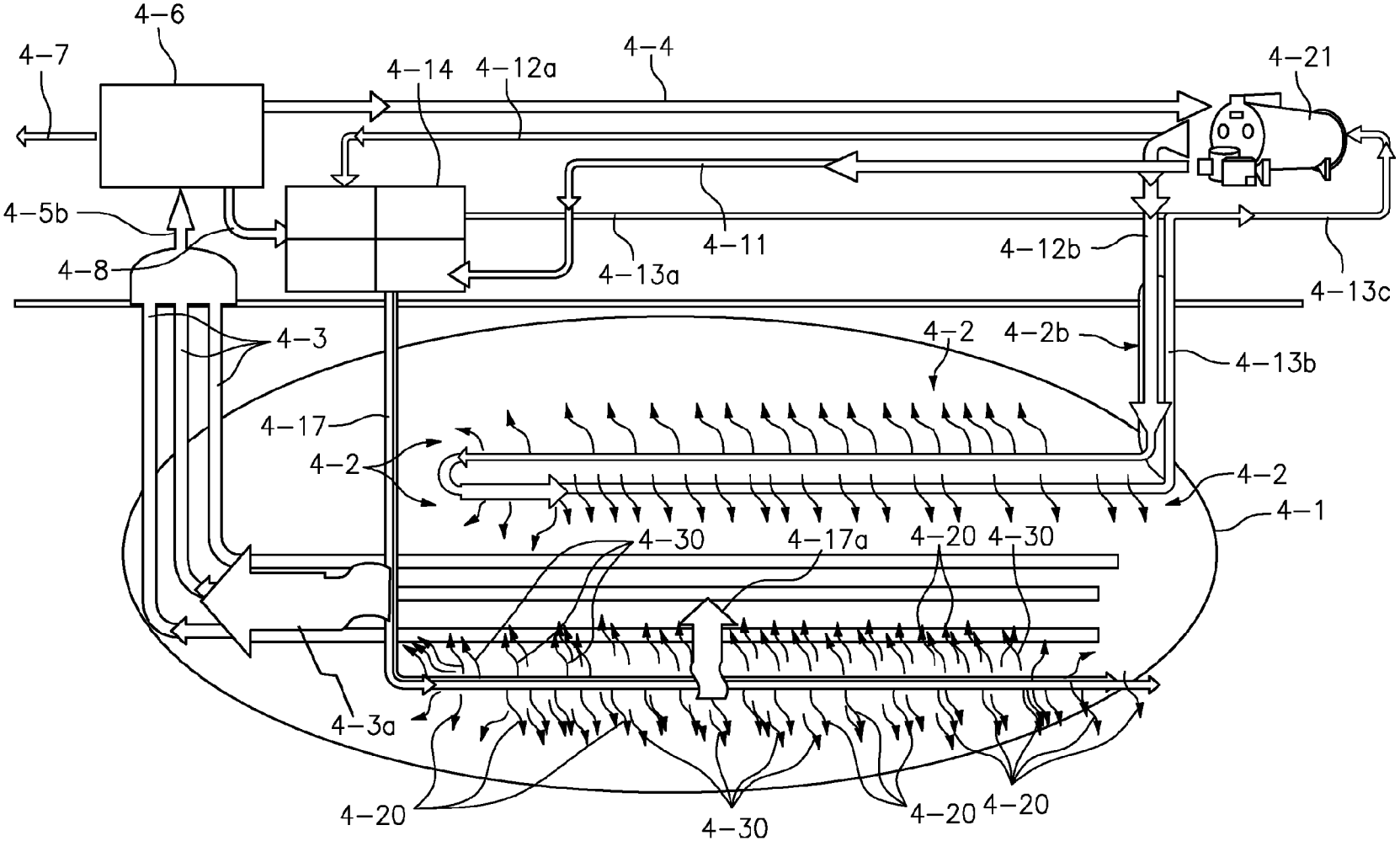
FIG. 4 shows yet another embodiment of a Green Boiler System using liquid to heat the Heat Delivery Wells instead of using a electrical resistant heater.

FIG. 4 shows another embodiment where the fluid heated in a Green Boiler 4-21 is circulated in a closed loop both above ground to and from a heat exchanger/mixer 4-14 and also below ground in a heat delivery well 4-2*b* in an underground oil/gas/brine reservoir 4-1. It should be realized that the heat delivery well 4-2*b* may be fed circulating hot fluid 4-12*b* by the boiler 4-21, or by a separate Green Boiler, or by another type of heat source. Wavy lines 4-2 are shown emanating from the heat delivery well 4-2*b* in the reservoir 4-1 to signify transfer of heat to heat the oil/gas/brine reservoir 4-1. Oil, gas, and brine produced from one or more production wells 4-3 is provided on a line 4-5*b* to at least one separator 4-6 that provides separated gas on a line 4-4 to the boiler 4-21, separated oil on a line 4-7 for storage, and separated brine on a line 4-8 to the heat exchanger/mixer 4-14. As in the case for FIGS. 2-3 as well, note that the separated gas is not flared but rather put to good use to increase hydrocarbon recovery flow rate. Hot exhaust 4-11 from the boiler 4-21 is provided to a mixer part of the heat exchanger/mixer 4-14 for mixing with the separated brine 4-8. The hot brine/exhaust mixture is injected into an injection well 4-17 where hot brine flooding takes place to heat the reservoir, displace the trapped hydrocarbons, and push or move them toward the one or more production wells 4-3. Wavy lines 4-20, 4-30 are shown emanating from the hot brine flooding well 4-17 into the reservoir 4-1 to signify the delivery of hot brine/$CO_2$ to heat the oil/gas/brine reservoir 4-1 and to push and displace gas and oil toward the one or more production wells 4-3. Hot water from the boiler is provided on a line 4-12*a* to the heat exchanger 4-14 where it transfers heat to the separated brine 4-8. The cooled fluid emerging from the heat exchanger on a line 4-13*a* may be joined with cooled fluid 4-13*b* emerging from the heat delivery well 4-2*b* before the joined fluids 4-13*c* are together returned to the boiler 4-21 for re-heating. The re-heated fluid emerges from the boiler on line 4-12*a* for connection to the heat exchanger 4-14 and on line 4-12*b* for connection to the heat delivery well 4-2*b* in a repeating cycle of heating, cooling, and re-heating.

Also shown in FIG. 4 pressure waves 4-3*a* may be generated in both the one or more production wells 4-3 and additional pressure waves 4-17*a* in the at last one injection well 4-17. The underground placement of the production and injection wells with respect to each other may be advantageously set up such that constructive interference is facilitated and controlled with the production and injection waves controlled so as to be stimulating the reservoir simultaneously, continuously and synchronized in phase so as to meet in the reservoir and add constructively, thereby increasing the amplitude of the stimulating force imparted to the reservoir. The spatial relationship should be such that at least part of the production wave 4-3*a* is propagated in a direction toward the injection well 4-17 and the injection wave 4-17*a* is propagated in the opposite direction toward the production well 4-3 so that the waves meet in a space in between the wells and interfere constructively as shown in FIG. 1(*g*).

Figure 5:
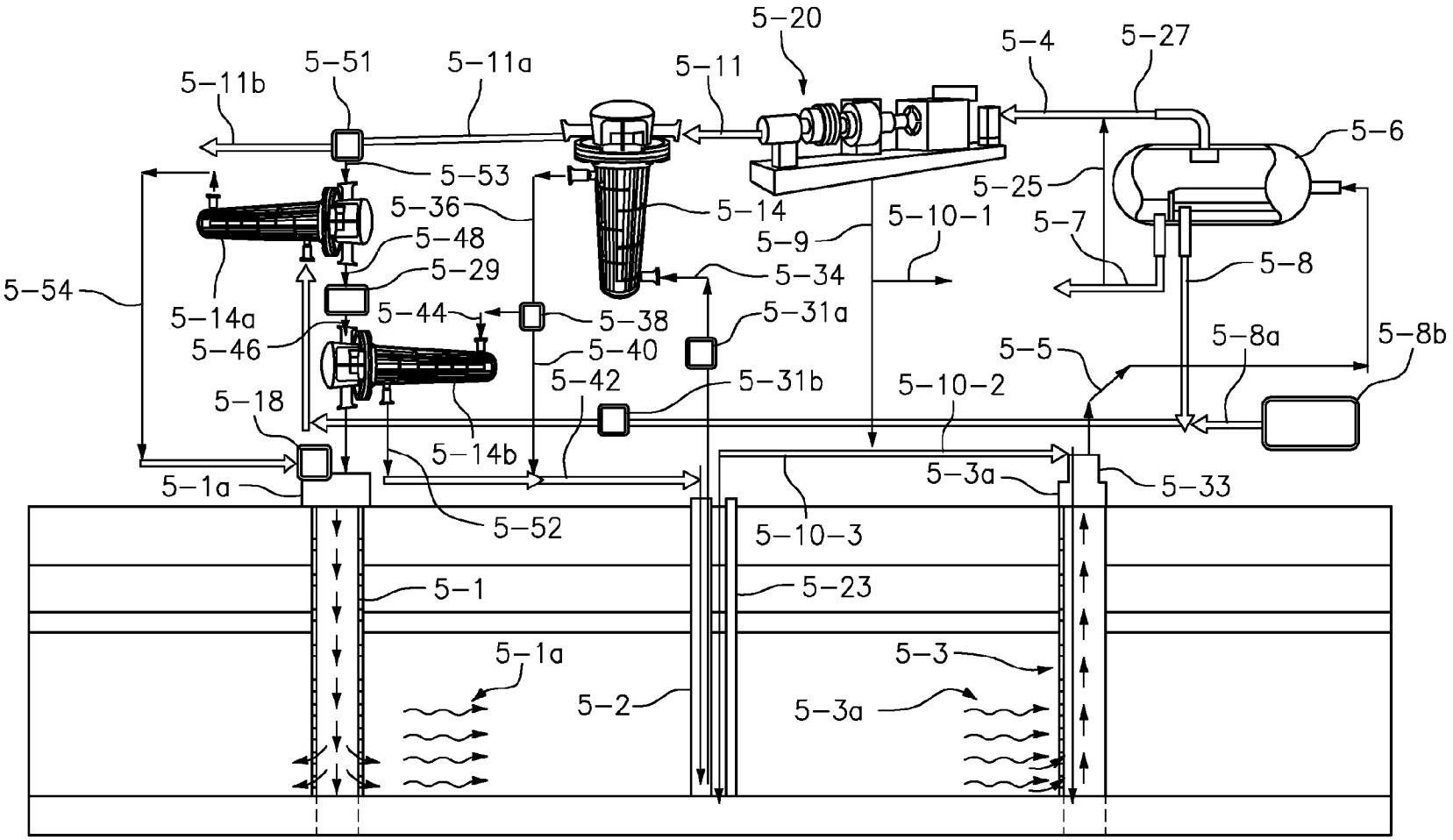
FIG. 5 shows a further embodiment of a system according to the teachings hereof, without a Green Boiler.

It should be realized that systems such as shown in FIGS. 3 and 4 are merely examples of systems assembled according to the teachings hereof. Various elements may be added to or subtracted from the illustrated systems. Likewise, various elements may be modified. For instance, the Green Boilers of FIGS. 3 and 4 may be omitted and the systems modified to operate simply by generating electricity by using a heat engine to convert natural gas and/or crude oil recovered from the underground reservoir to mechanical work and converting the mechanical work to electricity to heat one or more cables in the reservoir. Similarly, FIG. 5 shows yet another embodiment that doesn't necessarily use a "Green Boiler." Central to the system of FIG. 5 is an apparatus 5-20 (similar to the apparatus 3-20 of FIG. 3). The apparatus 5-20 includes a heat engine such as a gas turbine or reciprocating internal combustion engine fueled by recovered natural gas and/or crude oil on a line 5-4 to produce mechanical work to turn an electric generator that produces electricity on a line 5-9. The electrical output from the generator on line 5-9 may be connected to at least one electric heating cable

5-10-2, 5-10-3 that is placed in a heat delivery well 5-2 and/or a production well 5-3. Part of the electricity may be used for one or more other purposes such as power for a compressor 5-29, one or more pumps 5-1*a*, 5-3*a*, 5-31*a*, 5-31*b*, etc., as shown by electricity provided on a line 5-10-1. As in FIG. 3, a monitor well 5-23 may be provided to monitor one or more parameters necessary to properly control and coordinate the various forms of stimulation provided to the reservoir. The production well 5-3 includes a pump 5-3*a* that provides crude oil, natural gas, and brine/water on a line 5-5 to a separator 5-6 that separates the three fluids and provides recovered crude oil on a line 5-7 for transport and/or storage, recovered gas on a line 5-27 to the apparatus 5-20 via a line 5-4, and brine on a line 5-8 to a heat exchanger and/or mixer 5-14*a*. Optional additives 5-8*b* and/or additional water may be added to the separated brine/water on the line 5-8 as shown on a line 5-8*a*. Part of the recovered crude oil on the line 5-7 may be diverted as shown by a line 5-25 for fueling the apparatus 5-20 via the line 5-4 as discussed above either by itself or in combination with natural gas on the line 5-27 from the separator 5-6. It should be realized that the apparatus 5-20 may be fueled by recovered natural gas and all the recovered oil is provided for transport and/or storage. Hot exhaust on a line 5-11 from the heat engine part of the apparatus 5-20 is provided to an exhaust inlet of a heat exchanger and/or mixer 5-14 where heat may be transferred from the hot exhaust gas on the line 5-11 to the incoming brine on the line 5-34 (in that case an exhaust gas heat exchanger) or, as in FIG. 3, the hot exhaust may mixed with the brine on the line 5-34 pumped by the pump 5-31 from the heat delivery well 5-2, or both. This use of the hot exhaust on the line 5-11 for heating and/or mixing with the brine on the line 5-34 produces heated brine on a line 5-36 which is provided in whole or in part via a diverter valve 5-38 on a line 5-40 via a line 5-42 to the heat delivery well 5-2 in order to transfer heat to the underground reservoir. Likewise, the diverter valve 5-38 may provide the heated brine on the line 5-36 in whole or in part on a line 5-44 to an inlet of a heat exchanger and/or mixer 5-14*b* where it may be mixed with compressed exhaust gas on a line 5-46 from a compressor 5-29 which compresses leftover exhaust gas 5-48 it receives from an outlet of the heat exchanger/mixer 5-14*a* or where it may be heated by the compressed exhaust gas, or both. Partially cooled exhaust gas on a line 5-11*a* from the heat exchanger and/or mixer 5-14 is diverted by a diverter valve 5-51 on a line 5-53 into an inlet of the heat exchanger and/or mixer 5-14*a* or is diverted in whole or in part on a line 5-11*b* for residual exhaust venting. The heat exchanger and/or mixer 5-14*b* provides heated brine on a line 5-52 for delivery e.g. via line 5-42 to the heat delivery well 5-2 or to any other well in order to heat the reservoir. Heated brine is pumped by a pump 5-1*a* on a line 5-54 from the heat exchanger and/or mixer 5-14*a* to a production well 5-1 via an oscillator 5-18 that produces pressure waves 5-1*a* in the pumped heated brine as it is injected into the injection well 5-1. Likewise, an oscillator 5-33 produces pressure waves 5-3*a* that are controlled so as to be synchronized and in phase with the pressure waves 5-1*a* as they propagate toward the pressure waves 5-1*a* for constructive interference.

In one or more of the various embodiments one or more pumps are employed for extracting crude oil, natural gas, and brine/water from one or more corresponding production wells in an underground reservoir. At least one separator is used to separate the extracted crude oil, natural gas, and brine to provide separated crude oil, natural gas, and brine. At least one heating device or heat source is fueled by the separated crude oil, natural gas, or both, the heating device comprising at least one of a heating vessel for heating a fluid for providing heated fluid, or a heat source for generating thermal energy and a heat engine for converting the thermal energy to mechanical work. At least one of a heat exchanger and an electric generator is provided, the heat exchanger for receiving the separated brine and the heated fluid for transferring heat from the heated fluid to the separated brine for providing heated brine, and the generator for providing electricity and rotatable by a shaft of the heat engine coupled to a shaft of the generator, the heat engine comprising at least one of a turbine rotatable by thermal energy of a gas or vapor heated by the heat source moving through the turbine to act on blades attached to the shaft to move the blades and impart rotational energy to the shaft of the heat engine or an internal combustion engine for converting chemical energy of one or more of diesel, the extracted crude oil, or the extracted natural gas to the mechanical work for imparting rotational energy to the shaft of the heat engine. Also shown is at least one of an injection pump and an electric heating cable, the injection pump for injecting the heated brine into one or more injection wells in the underground reservoir to transfer heat to unrecovered crude oil in the reservoir so as to reduce viscosity of the unrecovered crude oil and enhance flow of the unrecovered crude oil to the one or more production wells, the electric heating cable heated by the electricity provided by the generator and located in at least one of the one or more heat delivery wells, the one or more production wells, or the one or more injection wells for heating the underground reservoir.

Further, in one or more of the various embodiments a stimulator may be employed for stimulating the underground reservoir with pressure waves propagated into the underground reservoir by stimulating the heated brine during injection. The disclosed systems may further include an additional stimulator for stimulating the underground reservoir with additional pressure waves propagated into the underground reservoir by stimulating the oil, gas, and brine during extraction from the underground reservoir, wherein the additional pressure waves are in phase with the pressure waves propagated into the underground reservoir by stimulating the heated brine during injection. The stimulator, the additional stimulator or both may comprise a self-powered device for inducing modulation in a flowing fluid stream.

Further, a mixer has been shown employed for mixing exhaust gas from at least one of the heating vessel and the heat engine with the separated brine at least before, during, or after the transfer of heat from the heated fluid to the separated brine wherein the injection pump is for injecting the heated brine mixed with the exhaust gas into the one or more injection wells. A system including the mixer may include a stimulator for stimulating the underground reservoir with pressure waves propagated into the underground reservoir by stimulating the heated brine mixed with the exhaust gas in the one or more injection wells. A system including the mixer may further comprise an additional stimulator for stimulating the underground reservoir with additional pressure waves propagated into the underground reservoir by stimulating the oil, gas, and brine during extraction from the underground reservoir, wherein the additional pressure waves are controlled in phase with the pressure waves propagated into the underground reservoir by stimulating the brine mixed with the exhaust gas during injection. The stimulator, the additional stimulator or both may comprise a self-powered device for inducing modulation in a flowing fluid stream.

Still further, other embodiments of the heated fluid may include steam, in that case the turbine comprising a steam turbine, responsive to the steam from the heating vessel to operate a generator to provide electricity, and the apparatus may further comprise at least one electric heating cable, responsive to the electricity, for providing additional heat to the underground reservoir via the one or more production wells, the one or more injection wells, or one or more separate heat delivery wells, or via any combination of the production, injection, and heat delivery wells.

Embodiments have been shown wherein the heating vessel comprises a plurality of heating vessels, each for heating a portion the heated fluid provided to the heat exchanger and for receiving from the heat exchanger a corresponding cooled portion of the fluid circulating between the at least one heat exchanger and the plurality of heating vessels.

Further embodiments include the one or more corresponding production wells including a plurality of production wells for providing crude oil, natural gas, and brine extracted from the underground reservoir to one or more separators for separating the extracted crude oil, natural gas, and brine for providing separated crude oil, natural gas, or both, to at least one corresponding manifold, each manifold comprising a plurality of oil or gas outlets for providing fuel for burning in a plurality of heating vessels and a heat source or for burning in pluralities of both heating vessels and heat sources.

The various embodiments shown above as well as variations based on the teachings hereof use gas and/or crude oil from a reservoir to create thermal energy for enhanced oil recovery in a cycling fashion. In contrast to gas currently being flared and/or wasted, the disclosed systems eliminate emissions caused by openly burning recovered gas to constructively use the gas to create thermal energy to enhance the oil recovery. This approach eliminates flaring gas and the associated emissions of $CO_2$, $N_2$, and other gases. It eliminates the exhaust by injecting the exhaust back into the reservoir for gas flooding and miscibility. If the flaring gas will not create enough thermal energy, crude oil can be burned. Crude oil can be used in conjunction with the recovered gas or it can be used for the entire thermal requirement. The teachings hereof have shown how to create a closed loop cycle where the system continuously provides the power and resources out of the reservoir itself to enhance the extraction of oil and gas therefrom while cost effectively and significantly reducing the environmental impact.

The invention claimed is:

1. A method comprising:

extracting crude oil, natural gas, or crude oil and natural gas from an underground reservoir through a production well, burning crude oil or natural gas extracted from an underground reservoir, or burning both crude oil and natural gas extracted from an underground reservoir, for providing thermal energy, transferring the thermal energy to brine separated from the extracted oil, gas, or both, for providing heated brine, or converting the thermal energy to mechanical work, or both transferring the thermal energy to the separated brine and converting the thermal energy to mechanical work, and injecting the heated brine into the underground reservoir through an injection well separate from the production well;

wherein the method further comprises:

stimulating the underground reservoir with pressure waves propagated into the underground reservoir by stimulating the heated brine during injection while in the injection well; and stimulating the underground reservoir with additional pressure waves propagated into the underground reservoir by stimulating the oil, gas, and brine while in the production well during extraction from underground, wherein the additional pressure waves are controlled such that the additional pressure waves propagate in phase with the pressure waves propagated into the underground reservoir by stimulating the heated brine during injection.

2. The method of claim 1, further comprising mixing exhaust gas from at least one of a heating vessel and a heat engine with the separated brine at least before, during, or after the transfer of thermal energy to the separated brine wherein the heated brine mixed with the exhaust gas is injected into the underground reservoir via one or more injection wells.

3. An apparatus comprising:

a production well for extracting crude oil extracting crude oil, natural gas, or crude oil and natural gas from an underground reservoir a means for burning crude oil or natural gas extracted from an underground reservoir, or for burning both crude oil and natural gas extracted from an underground reservoir, for providing thermal energy, a means for transferring the thermal energy to brine separated from the extracted oil, gas, or both, for providing heated brine, or for converting the thermal energy to mechanical work, or for both transferring the thermal energy to the separated brine and converting the thermal energy to mechanical work, and an injection well for injecting the heated brine into the underground reservoir;

wherein the apparatus further comprises:

a means for stimulating the underground reservoir with pressure waves propagated into the underground reservoir by stimulating the heated brine during injection while in the injection well, and a means stimulating the underground reservoir with additional pressure waves propagated into the underground reservoir by stimulating the crude oil, natural gas, and brine while in the production well during extraction from underground, wherein the additional pressure waves are controlled such that the additional pressure waves propagate in phase with the pressure waves propagated into the underground reservoir by stimulating the heated brine during injection.

4. The apparatus of claim 3, further comprising a means for mixing exhaust gas from at least one of a heating vessel and a heat engine with the separated brine at least before, during, or after the transfer of heat from the heated fluid to the separated brine wherein the heated brine mixed with the exhaust gas is injected into the underground reservoir via one or more injection wells.

5. An apparatus comprising:

one or more pumps for extracting crude oil, natural gas, and brine from one or more corresponding production wells in an underground reservoir;

at least one separator for separating the extracted crude oil, natural gas, and brine for providing separated crude oil, natural gas, and brine;

at least one heating device fueled by the separated crude oil, natural gas, or both, the heating device comprising a heating vessel for heating a fluid for providing heated fluid, and a heat source for generating thermal energy and comprising a heat engine for converting the thermal energy to mechanical work, the heat engine comprising at least one of a turbine rotatable by thermal energy of a gas or vapor heated by the heat source moving through the turbine to act on blades attached to the shaft to move the blades and impart rotational energy to the shaft of the heat engine or an internal combustion engine for converting chemical energy of one or more of diesel, the extracted crude oil, or the extracted natural gas to the mechanical work for imparting rotational energy to the shaft of the heat engine;

at least one of a heat exchanger or an electric generator, the heat exchanger for receiving the separated brine and the heated fluid for transferring heat from the heated fluid to the separated brine for providing heated brine, the generator for providing electricity and rotatable by a shaft of the heat engine coupled to a shaft of the generator, and at least one injection pump, the injection pump for injecting the heated brine into one or more injection wells in the underground reservoir to transfer heat to unrecovered crude oil in the reservoir so as to reduce viscosity of the unrecovered crude oil and enhance flow of the unrecovered crude oil to the one or more production wells.

6. The apparatus of claim 5, further comprising a stimulator for stimulating the underground reservoir with pressure waves propagated into the underground reservoir by stimulating the heated brine during injection.

7. The apparatus of claim 6, further comprising an additional stimulator for stimulating the underground reservoir with additional pressure waves propagated into the underground reservoir by stimulating the oil, gas, and brine during extraction from the underground reservoir, wherein the additional pressure waves are in phase with the pressure waves propagated into the underground reservoir by stimulating the heated brine during injection.

8. The apparatus of claim 5, further comprising a mixer for mixing exhaust gas from at least one of the heating vessel and the heat engine with the separated brine at least before, during, or after the transfer of heat from the heated fluid to the separated brine wherein the injection pump is for injecting the heated brine mixed with the exhaust gas into the one or more injection wells.

9. The apparatus of claim 8, further comprising a stimulator for stimulating the underground reservoir with pressure waves propagated into the underground reservoir by stimulating the heated brine mixed with the exhaust gas in the one or more injection wells.

10. The apparatus of claim 9, further comprising an additional stimulator for stimulating the underground reservoir with additional pressure waves propagated into the underground reservoir by stimulating the oil, gas, and brine during extraction from the underground reservoir, wherein the additional pressure waves are controlled in phase with the pressure waves propagated into the underground reservoir by stimulating the brine mixed with the exhaust gas during injection.

11. The apparatus of claim 10, wherein the additional stimulator comprises a self-powered device for inducing modulation in a flowing fluid stream.

12. The apparatus of claim 9, wherein the stimulator comprises a self-powered device for inducing modulation in a flowing fluid stream.

13. The apparatus of claim 5, wherein said heated fluid includes steam, the turbine comprising:

a steam turbine, responsive to the steam from the heating vessel to operate a generator to provide electricity; and at least one electric heating cable, responsive to the electricity, for providing additional heat to the underground reservoir via the one or more production wells, the one or more injection wells, or one or more separate heat delivery wells, or via any combination of the production, injection, and heat delivery wells.

14. The apparatus of claim 5, wherein the heating vessel comprises a plurality of heating vessels, each for heating a portion the heated fluid provided to the heat exchanger and for receiving from the heat exchanger a corresponding cooled portion of the fluid circulating between the at least one heat exchanger and the plurality of heating vessels.

15. The apparatus of claim 5, wherein the one or more corresponding production wells comprise a plurality of production wells for providing crude oil, natural gas, and brine extracted from the underground reservoir to the one or more separators for separating the extracted crude oil, natural gas, and brine for providing separated crude oil, natural gas, or both, to at least one corresponding manifold, each manifold comprising a plurality of oil or gas outlets for providing fuel for burning in a plurality of heating vessels and at least one heat source.

16. An apparatus comprising:

one or more pumps for extracting crude oil, natural gas, and brine from one or more corresponding production wells in an underground reservoir;

at least one separator for separating the extracted crude oil, natural gas, and brine for providing separated crude oil, natural gas, and brine;

at least one heating device fueled by the separated crude oil, natural gas, or both, the heating device comprising a heating vessel for heating a fluid for providing heated fluid, and a heat source for generating thermal energy and a heat engine for converting the thermal energy to mechanical work;

a heat exchanger for receiving the separated brine and the heated fluid for transferring heat from the heated fluid to the separated brine for providing heated brine; and an injection pump for injecting the heated brine into one or more injection wells in the underground reservoir to transfer heat to unrecovered crude oil in the reservoir so as to reduce viscosity of the unrecovered crude oil and enhance flow of the unrecovered crude oil to the one or more production wells.

17. An apparatus comprising:

one or more pumps for extracting crude oil, natural gas, and brine from one or more corresponding production wells in an underground reservoir;

at least one separator for separating the extracted crude oil, natural gas, and brine for providing separated crude oil, natural gas, and brine;

a heat engine comprising at least one of a turbine rotatable by thermal energy of a gas or vapor heated by the heat source moving through the turbine to act on blades attached to the shaft to move the blades and impart rotational energy to the shaft of the heat engine or an internal combustion engine for converting chemical energy of one or more of diesel, the extracted crude oil, or the extracted natural gas to the mechanical work for imparting rotational energy to the shaft of the heat engine; and at least one of a heat exchanger or an electric generator, wherein the heat exchanger receives the separated brine and heated fluid for transferring heat from the heated fluid to the separated brine for providing heated brine to at least one injection pump for injecting the heated brine into one or more injection wells in the underground reservoir to transfer heat to unrecovered crude oil in the reservoir so as to reduce viscosity of the unrecovered crude oil and enhance flow of the unrecovered crude oil to the one or more production wells, and wherein the generator provides electricity to an electric heating cable and is rotatable by a shaft of the heat engine coupled to a shaft of the generator, the electric heating cable being located in at least one of the one or more heat delivery wells, the one or more production wells, or the one or more injection wells for heating the underground reservoir.

* * * * *